United States Patent [19]

Feldkämper

[11] 4,210,320

[45] Jul. 1, 1980

[54] VACUUM CONTROL FOR SHEET APPLICATOR MACHINES

[75] Inventor: Richard Feldkämper, Lengerich, Fed. Rep. of Germany

[73] Assignee: Windmoller & Holscher, Lengerich, Fed. Rep. of Germany

[21] Appl. No.: 3,880

[22] Filed: Jan. 16, 1979

[30] Foreign Application Priority Data

Jan. 20, 1978 [DE] Fed. Rep. of Germany ..... 2802475

[51] Int. Cl.[2] ..... B65H 3/08

[52] U.S. Cl. ..... 271/108; 271/12

[58] Field of Search ..... 271/11, 12, 14, 90, 271/108

[56] References Cited

U.S. PATENT DOCUMENTS

| | | | |
|---|---|---|---|
| 1,418,145 | 5/1922 | Fischer | 271/108 X |
| 2,591,116 | 4/1952 | Backhouse | 271/108 |
| 4,002,332 | 1/1977 | Hoenigmann | 271/11 |

FOREIGN PATENT DOCUMENTS 707044 4/1954 United Kingdom .

*Primary Examiner*—Robert W. Saifer
*Attorney, Agent, or Firm*—Fleit & Jacobson

[57] ABSTRACT

A sheet applicator particularly suitable for bag-making machines comprises suction members controlled by a three-way valve to apply a vacuum to them at a sheet withdrawing station and atmospheric pressure when they have been reciprocated to a sheet releasing station. The valve comprises a first chamber communicating with atmospheric pressure and a second chamber of larger diameter than the first communicating with a source of vacuum, the chambers being alternately connected to the suction members by a valve plate displaceable between the chambers to close one of them and open the other. A spring acts on the valve plate with a force insufficient to displace it when it is closing the said second chamber but sufficient to hold it closed when it is closing the first chamber. Actual displacement of the valve plate is effected by a valve rod therefor striking abutments at the sheet withdrawing and sheet releasing stations.

2 Claims, 2 Drawing Figures

FIG. 1
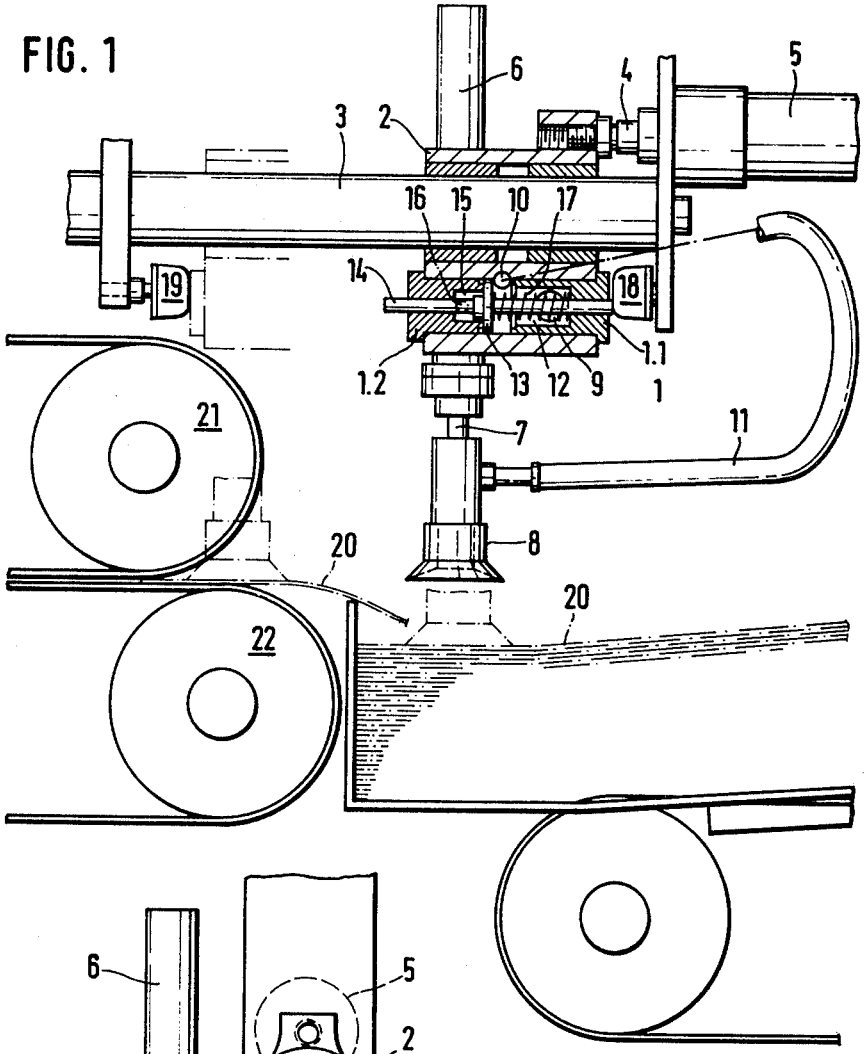
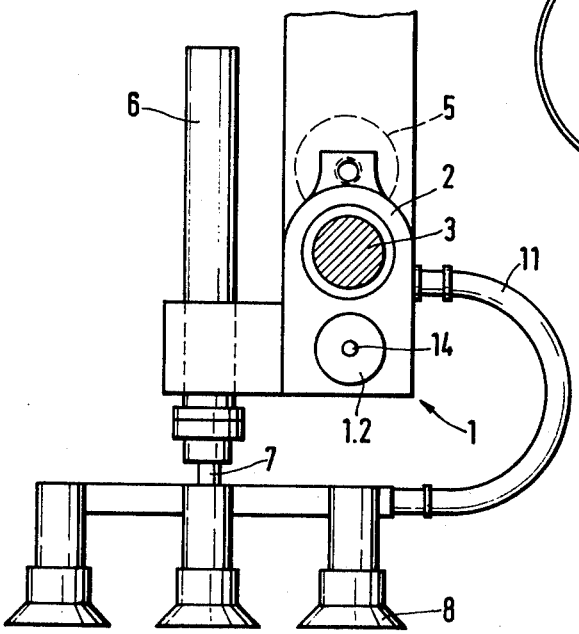
FIG. 2

VACUUM CONTROL FOR SHEET APPLICATOR MACHINES

The invention relates to a vacuum control for sheet applicator machines, particularly for base formers of bag-making machines, comprising suckers which lift the sheets individually and are connected to a vacuum source by way of a controlled three-way valve.

In a vacuum control of this kind known from DE-AS 22 20 469, the three-way valve has two inlets for atmospheric air, of which one is rhythmically closed during the suction strokes of the air piston pump producing the vacuum and opened during the compression strokes and the other is closed by a valve plate which can be lifted off by an electromagnet when control equipment signals a defective position of workpieces or the suckers are to be switched off for other reasons. In the known vacuum control, the suction phases of the suckers for lifting and transporting the sheets are governed by the length of the suction stroke of the air piston pump producing the vacuum, and thus the transporting motion of the suckers if subjected to narrow limits.

It is therefore the problem of the invention to provide a vacuum control for suckers that positively controls the vacuum in response to the spatial position of the suckers and switches from venting from suction and vice versa only after reaching the respective limiting positions.

According to the invention, this problem is solved in a vacuum control of the aforementioned kind in that the three-way valve comprises a chamber communicating with the atmosphere and a chamber communicating with the vacuum source, the chambers being alternately connected to the conduit leading to the suckers by means of a valve plate which is displaceable between the chambers to close one of them and which is controlled by the reciprocating conveying motion of the suckers, and that the valve is biassed by a spring which cannot overcome the suction acting on the valve plate when the vacuum chamber is closed and which, when the atmospheric chamber having a smaller diameter than that of the vacuum chamber is closed, holds the valve plate against atmospheric pressure in its position when it seals the atmospheric chamber. The vacuum control according to the invention permits lifting and separation of sheets or sack workpieces from stacks thereof and their application to conveying means, the vacuum being controlled by the transporting motion of the suckers to ensure faultless operation. The vacuum control according to the invention has a simple and reliable construction dispensing with expensive equipment for holding the valve plate in its positions where it closes either the atmospheric chamber or the vacuum chamber. By dimensioning the spring acting on the valve plate as well as the cross-sections of the chambers closed thereby, the cross-sections acting on the valve plate, a bistable switching system has been produced in which the respective switching position of the valve plate is maintained until the valve plate is switched over.

Simple switching-over of the valve plate is achieved if the three-way valve is reciprocatable with the suckers and comprises rod means which carry the valve plate and the ends of which projecting from the valve housing run up against fixed buffers in the extreme positions of the housing for switching the valve plate over.

An example of the invention will now be described in more detail with reference to the drawing in which:

FIG. 1 is a diagrammatic side elevation of a sheet applicator machine with a three-way valve in longitudinal section for controlling the vacuum, and FIG. 2 is an end elevation of the three-way valve with the suckers connected thereto.

A three-way valve 1 consists, inter alia, of two bodies 1.1 and 1.2 accommodated in a housing 2. The housing 2 is readily displaceable on a fixed guide rod 3 and secured to the piston rod 4 of a fixed pressure cylinder 5. The cylinder 6 of a piston-cylinder unit is secured to the housing 2 and its piston rod 7 is fixed to a row of suckers 8. The three-way valve 1 comprises a connection 9 for a vacuum source (not shown) and a connection 10 which communicates with the suckers 8 by a flexible conduit 11. The connection 9 leads to a vacuum chamber 12 with a relatively large cross-section. It can be sealed by a valve plate 13 which is secured to a valve rod 14 displaceable in the bodies 1.1 and 1.2 of the three-way valve 1 and can be displaced over a distance substantially equal to the internal width of the connection 10. In the extreme righthand position of the valve plate 13, the vacuum chamber 12 is sealed and in the extreme left-hand position the atmospheric chamber 15 is sealed, the latter communicating with the atmosphere through a hole 16. The valve plate 13 is pushed to the left by a compression spring 17 which is dimensioned so that it retains its position despite the atmospheric pressure acting on it. In the left-hand limiting position of the valve plate 13, the compression spring 17 is supported in its action because the atmospheric chamber 15 to be sealed by the valve plate 13 has a smaller cross-section, so that the force exerted by the atmosphere is relatively small.

The suckers 8 can thus be alternately brought into communication with the atmosphere and the vacuum source, depending on the position of the valve plate 13. In registry with the valve rod 14 there are fixed abutments 18, 19 in the form of resilient buffers. In the position shown in FIG. 1, the valve rod 14 is disposed against the abutment 18 and the valve plate 13 seals off the atmospheric chamber 15 so that the vacuum source is connected to the suckers 8. By actuating the piston-cylinder unit 6, the suckers 8 are lowered onto a workpiece 20 and raised again, whereby the workpiece 20 is also lifted under the suction effect. By actuating the piston-cylinder unit 5, the housing 2 and thus the workpiece 20 held by the suckers 8 are moved to the left so that the leading edge of the workpiece 20 reaches the nip of the conveyor rollers 21, 22. At the same time, the part of the valve rod 14 projecting to the left beyond the body 1.2 of the three-way valve 1 strikes the abutment 19, whereby the valve rod 14 is displaced to the right until the valve plate 13 reaches its righthand limiting position and seals the vacuum chamber 12 and whereby the suckers 8 are connected to the atmospheric chamber 15 by releasing the connection 10. The suckers 8 therefore release the workpiece 20 which can now be conveyed by the conveyor rollers 21, 22 without hindrance.

During return motion of the three-way valve 3 to its right-hand limiting position by reversing the piston-cylinder unit 5, the valve plate 13 is held tight under the sub-atmospheric pressure which is produced by the vacuum source and which obtains in the vacuum chamber 12. This is because, by reason of the larger cross-section of the vacuum chamber 12, a force is exerted on the valve plate 13 that is larger than the force of the compression spring 17. Consequently, the suckers 8 remain connected to atmosphere on their return path to the right-hand limiting position until the valve rod 14 strikes the abutment 18 and the three-way valve switches over to suction. A new cycle can now commence.

I claim:

1. A vacuum control for sheet applicator machines, particularly for the base formers of bag-making machines, comprising suckers which lift the sheets individually, have a reciprocating conveying motion and are connected to a vacuum source by way of a controlled three-way valve, characterised in that the three-way valve (1) comprises a chamber (15) communicating with the atmosphere and a chamber (12) communicating with the vacuum source, the chambers being alternately connected to a conduit (10, 11) leading to the suckers (8) by means of a valve plate (13) which is displaceable between the chambers (15, 12) to close one of them and which is controlled by the reciprocating conveying motion of the suckers (8), and that the valve plate 13 is biassed by a spring (17) which cannot overcome the suction acting on the valve plate (13) when the vacuum chamber (12) is closed and which, when the atmospheric chamber (15) having a smaller diameter than that of the vacuum chamber (12) is closed, holds the valve plate (13) against atmospheric pressure in its position where it seals the atmospheric chamber (15).

2. A vacuum control according to claim 1, characterised in that the three-way valve (1) has a value housing and is reciprocatable with the suckers (8) and comprises rod means (14) which carry the valve plate (13) and the ends of which project from the valve housing (2) and run up against fixed buffers (18, 19) in the extreme positions of the housing for switching the valve plate (13) over.

* * * * *